US006885391B2

(12) United States Patent
Shiraishi et al.

(10) Patent No.: US 6,885,391 B2
(45) Date of Patent: Apr. 26, 2005

(54) THERMAL DEVELOPMENT APPARATUS

(75) Inventors: Takehiro Shiraishi, Ome (JP); Makoto Sumi, Tokorozawa (JP); Makoto Horiuchi, Kodaira (JP)

(73) Assignee: Konica Corporation, Tokyo (JP)

( * ) Notice: Subject to any disclaimer, the term of this patent is extended or adjusted under 35 U.S.C. 154(b) by 119 days.

(21) Appl. No.: 10/404,453

(22) Filed: Apr. 2, 2003

(65) Prior Publication Data

US 2003/0190558 A1 Oct. 9, 2003

(30) Foreign Application Priority Data

Apr. 5, 2002 (JP) ..... 2002-104001

(51) Int. Cl.[7] ..... G03D 13/00; G03G 15/06; G03G 13/06

(52) U.S. Cl. ..... 347/228; 347/156; 430/336

(58) Field of Search ..... 347/140, 155, 347/156, 228; 219/216; 430/336, 337

(56) References Cited

U.S. PATENT DOCUMENTS 5,414,488 A * 5/1995 Fujita et al. ..... 355/30
6,784,911 B1 * 8/2004 Umeki et al. ..... 347/228
2003/0118926 A1 * 6/2003 Sumi et al. ..... 430/30

* cited by examiner

*Primary Examiner*—Huan Tran
(74) *Attorney, Agent, or Firm*—Finnegan, Henderson, Farabow, Garrett & Dunner, L.L.P.

(57) ABSTRACT

There is described a thermal development apparatus, which makes it possible to prevent generation of density variations caused by changes of the processing temperature during the thermal developing operation when the thermal developing photosensitive material is continuously processed, without increasing the cost of the apparatus so much. The thermal development apparatus includes a thermal developing processor to apply a thermal development processing to the thermal developing photosensitive material, a detector to detect the thermal developing photosensitive material to be conveyed into the thermal developing processor and a controller to control the thermal developing processor in a feed forward controlling mode based on a processing condition of the thermal developing processor. The processing condition is established in advance, corresponding to a load of processing the thermal developing photosensitive material detected in advance by the detector.

20 Claims, 9 Drawing Sheets

THERMAL DEVELOPMENT APPARATUS

BACKGROUND OF THE INVENTION

The present invention relates to a thermal development apparatus by which the thermal developing photosensitive material is heated and developed.

The thermal development apparatus is an apparatus, for example, which is provided with a heating section having a heating member such as a heat roller whose temperature is controlled, a forcing member such as a forcing roller located opposite to the heating member, and a conveying section to convey the heated thermal developing photosensitive material, and by which, when, while an exposure-processed thermal developing photosensitive material is being forced onto the surface of the heating member by the forcing member, the material is closely adhered onto it, the thermal developing photosensitive material is heated and thermally developed.

In such a thermal development apparatus, when the thermal developing photosensitive material is continuously thermal developed, the temperature change of the thermal developing apparatus in a thermal development processing section is generated like the temperature lowering of the forcing member due to the case where the heat is taken by the thermal developing photosensitive material, or the temperature rise of a conveying section due to the heat supply from the heated thermal developing photosensitive material.

Due to the influence of such a temperature change in the thermal development processing section, the processing temperature difference is generated for each continuously processed thermal developing photosensitive material, and as a result, a predetermined density characteristic is not obtained in the thermal developing photosensitive material after the development, and the development density difference is generated.

As the countermeasure for this, there is a thermal development apparatus in which a feedback mechanism of the development density adjustment by conducting the adjustment of the exposure amount in the exposure processing section to form a latent image or the adjustment of the heating amount in the thermal development processing section, based on the measured density value in which the density of the thermal developing photosensitive material after the development is measured, or based on the detected temperature in which the temperature of the member of the thermal development processing section or the ambient temperature in the thermal development processing section is detected, is provided and the development of the predetermined density is conducted.

However, because such a feedback control is delayed in the time and the control is conducted, particularly in the case where the thermal developing photosensitive material is continuously processed, because, to the rapid temperature change of the thermal development processing section, the control does not follow the thermal developing photosensitive material which is thermal developed at the time point, there is a problem that the influence of the temperature difference of the thermal development processing section is subjected for each continuously processed thermal developing photosensitive material, and as a result, in the thermal developing photosensitive material after the development, the predetermined density characteristic is not obtained and the development density difference is generated. Further, in the thermal development apparatus provided with the feedback mechanism of the development density adjustment according to such a measured density or detected temperature, because the apparatus component members become many, there is also a problem that the cost is increased, and the apparatus itself is complicated.

SUMMARY OF THE INVENTION

To overcome the abovementioned drawbacks in conventional thermal development apparatus, it is an object of the present invention to provide a thermal development apparatus, which makes it possible to prevent generation of density variations caused by changes of the processing temperature during the thermal developing operation when the thermal developing photosensitive material is continuously processed, without increasing the cost of the apparatus so much.

Accordingly, to overcome the cited shortcomings, the abovementioned object of the present invention can be attained by thermal development apparatus and methods as follow.

(1) An apparatus for thermally developing a thermal developing photosensitive material, comprising: a thermal developing processor to apply a thermal development processing to the thermal developing photosensitive material; a detector to detect the thermal developing photosensitive material to be conveyed into the thermal developing processor; and a controller to control the thermal developing processor in a feed forward controlling mode based on a processing condition of the thermal developing processor; wherein the processing condition is established in advance, corresponding to a load of processing the thermal developing photosensitive material detected in advance by the detector.

(2) The apparatus of item 1, wherein the thermal developing processor includes: a heating section to heat the thermal developing photosensitive material so as to maintain a temperature of the thermal developing photosensitive material at a thermal developing temperature; and a cooling conveyance section to cool the thermal developing photosensitive material from the thermal developing temperature to a predetermined temperature while conveying it.

(3) The apparatus of item 2, wherein the processing condition is at least one of a first processing condition in regard to the thermal developing temperature of the heating section included in the thermal developing processor, a second processing condition in regard to a thermal developing time of the heating section included in the thermal developing processor and a third processing condition in regard to a cooling temperature of the cooling conveyance section included in the thermal developing processor.

(4) An apparatus for forming an image on a thermal developing photosensitive material, comprising: a data storage to store image data in it; a latent image forming section to form a latent image based on the image data, stored in the data storage, onto the thermal developing photosensitive material; a thermal developing processor to apply a thermal development processing to the thermal developing photosensitive material so as to convert the latent image to the image, serving as a visible image on it; and a controller to control the latent image forming section and/or the thermal developing processor in a feed forward controlling mode based on a processing condition for forming the image.

(5) The apparatus of item 4, wherein the thermal developing processor includes: a heating section to heat the thermal developing photosensitive material so as to maintain a temperature of the thermal developing photosensitive material at a thermal developing temperature; and a cooling conveyance section to cool the thermal developing photosensitive material from the thermal developing temperature to a predetermined temperature while conveying it.

(6) The apparatus of item 5, wherein the processing condition includes at least one of a first operating condition for the latent image forming section, a second operating condition for the heating section and a third operating condition for the cooling conveyance section, which are established in advance corresponding to a load of forming the image based on the image data stored in the data storage.

(7) The apparatus of item 6, further comprising: a calculating section to calculate a number of sheets to be processed per unit time, based on an amount of image data stored in the data storage; wherein the load is defined as the number of sheets to be processed per unit time; and wherein the controller controls the latent image forming section and/or the thermal developing processor in the feed forward controlling mode based on the processing condition corresponding to the number of sheets to be processed per unit time, calculated by the calculating section.

(8) The apparatus of item 6, further comprising: a storage controlling section to receive the image data from an external apparatus coupled through a communication network, and to control the data storage so as to store the image data received in it.

(9) The apparatus of item 6, wherein the processing condition is at least one of a first processing condition in regard to the thermal developing temperature of the heating section included in the thermal developing processor, a second processing condition in regard to a thermal developing time of the heating section included in the thermal developing processor, a third processing condition in regard to a cooling temperature of the cooling conveyance section included in the thermal developing processor and a fourth processing condition in regard to an exposing amount for forming the latent image in the latent image forming section.

(10) The apparatus of item 6, further comprising: a temperature detector to detect a temperature at the latent image forming section; wherein the controller controls the latent image forming section and/or the thermal developing processor in the feed forward controlling mode based on the processing condition corresponding to the temperature detected by the temperature detector.

(11) The apparatus of item 6, further comprising: an ambient temperature detector to detect an ambient temperature around the apparatus; wherein the controller controls the latent image forming section and/or the thermal developing processor in the feed forward controlling mode based on the processing condition corresponding to the ambient temperature detected by the ambient temperature detector.

(12) The apparatus of item 6, further comprising: a judging section to judge a kind of the thermal developing photosensitive material currently employed for forming the image; wherein the controller controls the latent image forming section and the thermal developing processor in the feed forward controlling mode based on the processing condition corresponding to the kind of the thermal developing photosensitive material determined by the judging section.

(13) The apparatus of item 6, wherein the controller controls the latent image forming section and/or the thermal developing processor in the feed forward controlling mode based on the processing condition corresponding to a current state of deterioration in respect to the heating section.

(14) A method for thermally developing a thermal developing photosensitive material, comprising the steps of: detecting the thermal developing photosensitive material to be conveyed into a thermal developing processor, which applies a thermal development processing to the thermal developing photosensitive material; and controlling the thermal developing processor in a feed forward controlling mode based on a processing condition for the thermal developing processor; wherein the processing condition is established in advance, corresponding to a load of processing the thermal developing photosensitive material detected in advance in the detecting step.

(15) The method of item 14, wherein the thermal developing processor includes: a heating section to heat the thermal developing photosensitive material so as to maintain a temperature of the thermal developing photosensitive material at a thermal developing temperature; and a cooling conveyance section to cool the thermal developing photosensitive material from the thermal developing temperature to a predetermined temperature while conveying it.

(16) The method of item 15, wherein the processing condition is at least one of a first processing condition in regard to the thermal developing temperature of the heating section included in the thermal developing processor, a second processing condition in regard to a thermal developing time of the heating section included in the thermal developing processor and a third processing condition in regard to a cooling temperature of the cooling conveyance section included in the thermal developing processor.

(17) A method for forming an image on a thermal developing photosensitive material, comprising the steps of: storing image data in a data storage; forming a latent image based on the image data, stored in the data storage, onto the thermal developing photosensitive material; applying a thermal development processing to the thermal developing photosensitive material so as to convert the latent image to the image, serving as a visible image on it; and controlling a forming operation of the latent image and the thermal development processing in a feed forward controlling mode based on a processing condition for forming the image.

(18) The method of item 17, wherein the thermal development processing includes the steps of: heating the thermal developing photosensitive material so as to maintain a temperature of the thermal developing photosensitive material at a thermal developing temperature; and cooling the thermal developing photosensitive material from the thermal developing temperature to a predetermined temperature.

(19) The method of item 18, wherein the processing condition includes at least one of a first operating condition for the forming operation of the latent image, a second operating condition for the heating step and a third operating condition for the cooling step, which are established in advance corresponding to a load of forming the image based on the image data stored in the data storage.

(20) The method of item 19, further comprising the steps of: calculating a number of sheets to be processed per unit time, based on an amount of image data stored in the data storage, each of the sheets corresponding to the thermal developing photosensitive material; wherein the load is defined as the number of sheets to be processed per unit time; and wherein the controller controls the forming operation of the latent image and the thermal development in the feed forward controlling mode based on the processing condition corresponding to the number of sheets to be processed per unit time, calculated in the calculating step.

Further, to overcome the abovementioned problems, other thermal development apparatus, embodied in the present invention, will be described as follow:

(21) A thermal development apparatus characterized in that, in a thermal development apparatus provided with a thermal development processing section having a heating section by which the thermal developing photosensitive material is heated and maintained at the thermal developing temperature and a cooling conveyance section by which the thermal developing photosensitive material is cooled from the thermal development temperature to a predetermined temperature, there is provided a sheet detection means for detecting previously the thermal developing photosensitive material conveyed to the thermal development processing section; and a control means for conducting the feed forward control according to the processing condition of the thermal development processing section which is previously set corresponding to a processing load when the thermal developing photosensitive material previously detected by the sheet detection means is thermal developed.

When the thermal developing photosensitive material is thermal developed, because the feed forward control according to the processing condition which is previously set corresponding to the processing load (for example, the processing number of sheets per unit time) of the thermal developing photosensitive material is conducted in the thermal development processing section, the desired thermal development can be conducted without confirming the situation at the thermal development or the result after the thermal development. Therefore, because the various detection sensors to confirm the situation at the thermal development or the result after the thermal development like in the case of the feedback control, become unnecessary and the apparatus component members can be decreased, the simplification of the apparatus and the reduction of the cost can be attained.

(22) The thermal development apparatus, characterized in that, in the thermal development apparatus recited in item (21), the processing condition is at least any one of the processing condition relating to the thermal development temperature of the heating section in the thermal development processing section, the processing condition relating to the thermal development time of the heating section in the thermal development processing section, and the processing condition relating to the cooling temperature of the cooling conveyance section in the thermal development processing section.

According to the invention described in item (22), it is of course that the same effect as that of item (21) can be obtained, and particularly, because, when at least any one processing condition of the thermal development temperature in the heating section, the thermal development time in the heating section, and the cooling temperature in the cooling conveyance section, is set, the feed forward control can be conducted, the adequate feed forward control can be conducted.

(23) A thermal development apparatus characterized in that, in the thermal development apparatus provide with a latent image forming section for forming a latent image according to the image data stored in the storing means on the thermal developing photosensitive material, and a thermal development processing section having a heating section by which the thermal developing photosensitive material on which the latent image is formed by the latent image forming section is heated and maintained at the thermal development temperature, and a cooling conveyance section by which the thermal developing photosensitive material is cooled from the thermal development temperature to a predetermined temperature, there is provided a control means for conducting the feed forward control according to at least any one of the processing conditions of the latent image forming section, heating section and cooling conveyance section, which is previously set corresponding to a processing load when the image data stored in the storing means is thermally developed.

According to the invention described in item (23), when the image data stored in the storing means is thermal developed, because the feed forward control according to the previously set processing condition corresponding to the processing load relating to the image data is conducted in at least any one of the latent image forming section, heating section and cooling conveyance section, the desired thermal development can be conducted without confirming the situation at the thermal development or the result after the thermal development. Further, according to the image data stored in the storing means, the time difference until the image data is thermally developed or printed for each thermal developing photosensitive material (for example, the time difference until the image data is the latent-image formed on the thermal developing photosensitive material or exposed in the latent image forming section) is calculated, and by controlling the time difference until the image data is thermally developed and printed, (for example, controlling at the timing at which the thermal developing photosensitive material is conveyed), the simulation of the temperature variation by the continuous processing in which the processing number of sheets per unit time at the continuous processing which is the processing load at the time of the thermal development is made uniform, can be conducted easily, and the program to conduct the feed forward control can be comparatively easily set. Accordingly, because the various detection sensors to confirm the situation at the thermal development or the result after the thermal development become unnecessary, and the apparatus component members can be decreased, the simplification of the apparatus and the reduction of the cost can be attained.

(24) The thermal development apparatus, characterized in that, in the thermal development apparatus recited in item (23), the processing load is the processing number of sheets per unit time; and according to the amount of the image data stored in the storing means, a calculation means for calculating the processing number of sheets per unit time is provided; and the control means conducts the feed forward control according to the processing condition corresponding to the processing number of sheets per unit time calculated by the calculation means.

According to the invention described in item (4), it is of course that the same effect as that described in item (23) is obtained, and particularly, according to the amount of the image data stored in the storing means, the calculation means calculates the processing number of sheets per unit time, and the feed forward control according to the processing condition corresponding to the calculated processing number of sheets per unit time can be conducted. Accordingly, the desired thermal development can be conducted corresponding to the image data, which is to be thermal developed without confirming the situation at the thermal development or the result after the thermal development.

(25) The thermal development apparatus, characterized in that, in the thermal development apparatus recited in item (24), a storing control means by which the image data is received from the outside apparatus connected through a communication line, and stored in the storing means, is provided.

According to the invention described in item (25), it is of course that the same effect as that described in item (23) or (24) is obtained, and particularly, by the storing control means, because the image data sent from the outside apparatus connected through the communication line can be stored, the image data received from the outside apparatus through the communication line can be collectively thermal development processed, and the thermal development can be conducted by the processing condition corresponding to the load when the collected image data is thermal development processed.

(26) The thermal development apparatus, characterized in that, in the thermal development apparatus recited in any one of items (23)–(25), the processing condition is at least one of the processing condition relating to the exposure amount for forming the latent image in the latent image forming section, the processing condition relating to the thermal development temperature of the heating section in the thermal development processing section, the processing condition relating to the thermal development time of the heating section in the thermal development processing section, and the processing condition relating to the cooling temperature of the cooling conveyance section in the thermal development processing section.

According to the invention described in item (26), it is of course that the same effect as that described in any one of items (23)–(25) is obtained, and particularly, because the feed forward control can be conducted by setting at least one processing condition of the exposure amount for forming the latent image in the latent image formation processing means, the thermal development temperature of the heating section in the thermal development processing means, the thermal development time of the heating section in the thermal development processing means, and the cooling temperature of the cooling conveyance section in the cooling processing means, the adequate feed forward control can be conducted.

(27) The thermal development apparatus, characterized in that, in the thermal development apparatus recited in any one of items (23)–(26), the latent image forming section temperature detection means for detecting the temperature in the latent image forming section is provided; and the control means, further, conducts the feed forward control according to the processing condition corresponding to the temperature detected by the latent image forming section temperature detection means.

According to the invention described in item (27), it is of course that the same effect as that described in any one of items (23)–(26) is obtained, and particularly, because, according to the processing condition corresponding to the temperature in the latent image forming section detected by the latent image forming section temperature detection means, the feed forward control can be conducted, even when the wavelength variation of the exposure light emitted by the latent image forming section is caused being brought by the temperature change, or the optical axis is dislocated by the thermal expansion change of each optical part of the latent image forming section, and the light amount variation is caused as a result, according to the processing condition corresponding to the light amount variation, the thermal development can be conducted.

(28) The thermal development apparatus, characterized in that, in the thermal development apparatus recited in any one of items (21)–(27), an ambient temperature detection means for detecting the ambient temperature of the periphery of the thermal development apparatus is provided; and the control means further conducts the feed forward control according to the processing condition corresponding to the ambient temperature detected by the temperature detection means.

According to the invention described in item (28), it is of course that the same effect as that described in any one of items (1)–(7) is obtained, and particularly, because, according to the ambient temperature detected by the ambient temperature detection means, and according to the processing condition corresponding to the ambient temperature of the periphery of the thermal development apparatus, the feed forward control can be conducted, the thermal development whose thermal development density difference is further small, in which the environmental temperature in which the thermal development apparatus is installed is included, can be conducted.

(29) The thermal development apparatus, characterized in that, in the thermal development apparatus recited in any one of items (21)–(28), a discriminating means for discriminating the kind of the thermal developing photosensitive material on which the thermal development is conducted, is provided; and the control means, according to the processing condition corresponding to the kind of the thermal developing photosensitive material discriminated by the discriminating means, further conducts the feed forward control.

According to the invention described in item (29), it is of course that the same effect as that described in any one of items (21)–(28) is obtained, and particularly, because the feed forward control can be conducted according to the kind of the thermal developing photosensitive material discriminated by the discriminating means, and according to the processing condition corresponding to the kind of the thermal developing photosensitive material, the thermal development whose thermal development density difference is further small, corresponding to the kind of the thermal developing photosensitive material, can be conducted.

(30) The thermal development apparatus, characterized in that, in the thermal development apparatus recited in any one of items (21)–(29), the control means further conducts the feed forward control according to the processing condition corresponding to the deterioration situation of the heating section.

According to the invention described in item (30), it is of course that the same effect as that described in any one of items (21)–(29) is obtained, and particularly, because the feed forward control can be conducted corresponding to the deterioration situation of the heating section in the thermal development apparatus, the thermal development can be conducted corresponding to the change of the thermal conductivity of the heating section brought by the deterioration.

Herein, the deterioration situation means a situation in which the contacting part or surface for heating the thermal developing photosensitive material, is deteriorated or worsened, while the thermal development processing is repeatedly conducted, and for example, the deterioration of the material of the heating section or the worsening of the situation by the adhesion of the dirt. When such deterioration occurs, because the thermal conductivity in the heating section is varied, the control corresponding to the variation is conducted.

In this connection, in order to recognize and judge the deterioration situation, it can be conducted by the detection of the color of the part or surface contacting for heating the thermal developing photosensitive material of the heating section, reflectance, coarseness (concave or convex), or by the detection of the thickness of the surface layer of the part. Further, the deterioration situation can be recognized and judged also by the detection of the difference between the surface temperature and the inside temperature of the part contacting for heating the thermal developing photosensitive material of the heating section. Further, the deterioration situation can be recognized and judged also by the using period of the thermal development apparatus or the detection of the quantitative numeral value of the accumulated processing number of the thermal developing photosensitive material on which the thermal development is conducted.

BRIEF DESCRIPTION OF THE DRAWINGS

Other objects and advantages of the present invention will become apparent upon reading the following detailed description and upon reference to the drawings in which.

DETAILED DESCRIPTION OF THE PREFERRED EMBODIMENT

Figure 1:
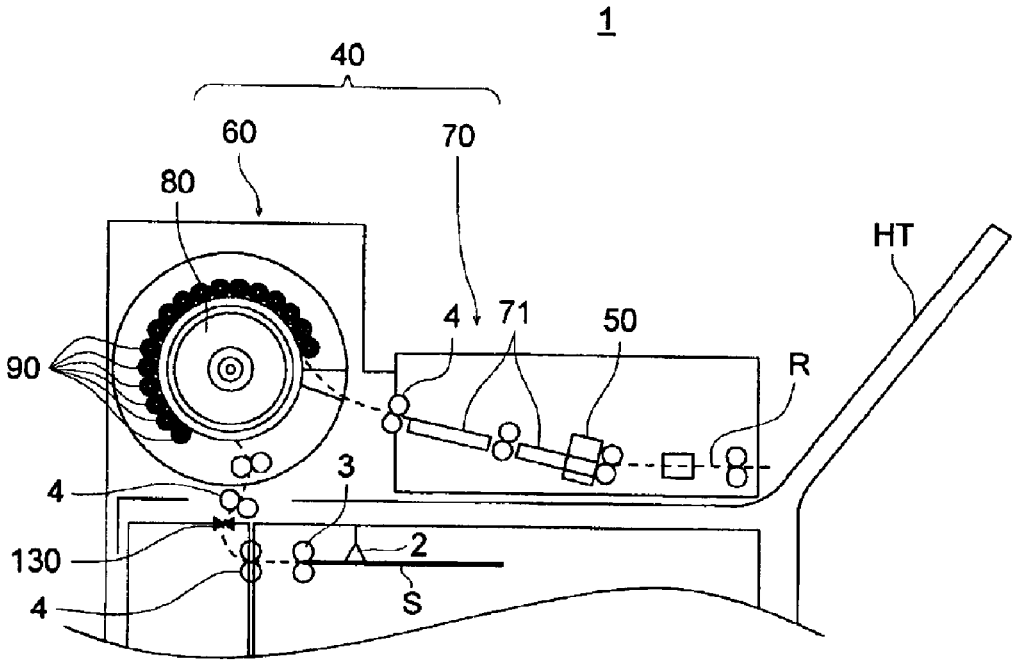
FIG. 1 is a front sectional view typically showing a thermal development apparatus in the first embodiment according to the present invention.

Referring to the drawings, embodiments of the present invention will be detailed below.

[The First Embodiment]

Figure 2:
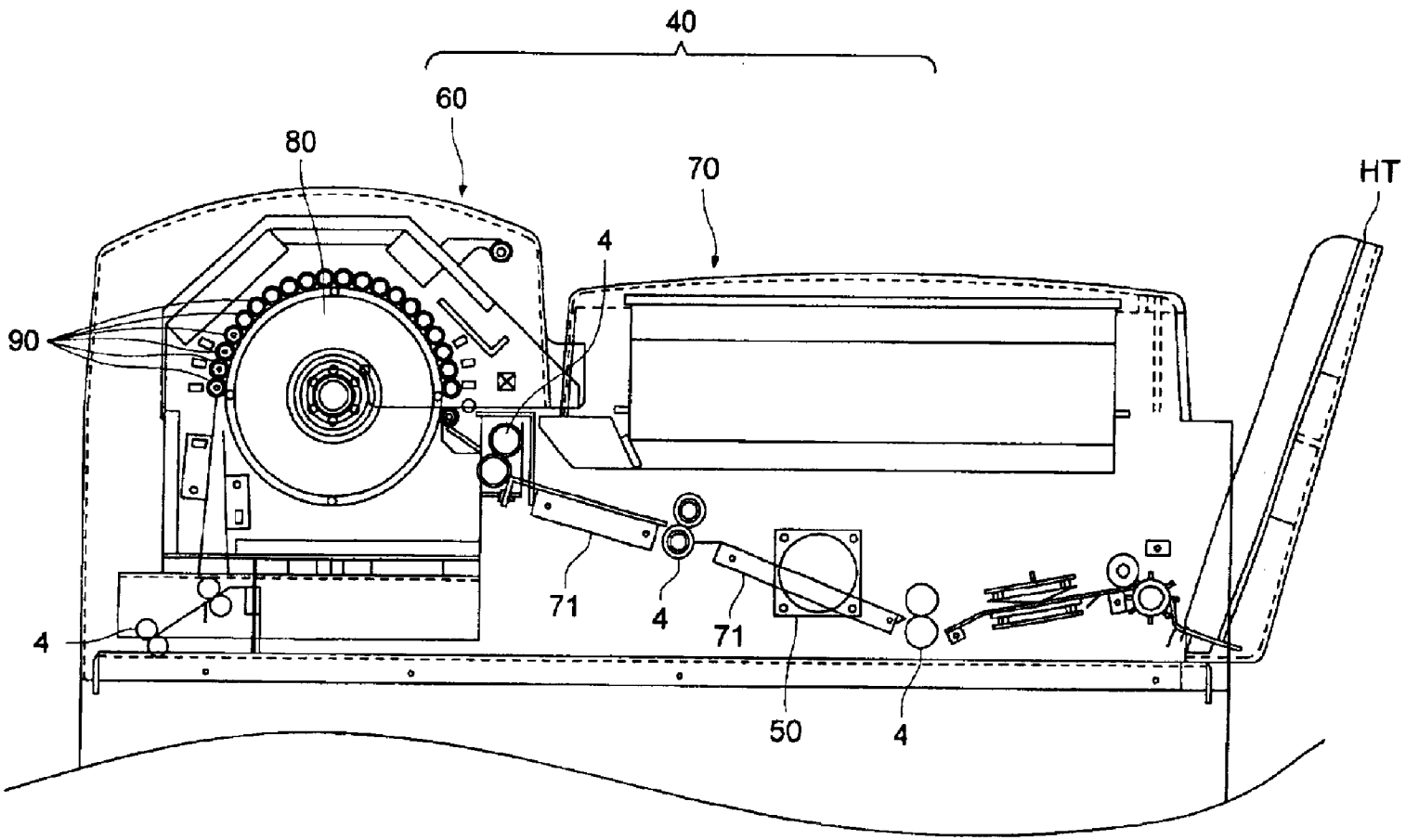
FIG. 2 is a front sectional view typically showing a thermal development processing section of the thermal development apparatus according to the present invention.
Figure 3:
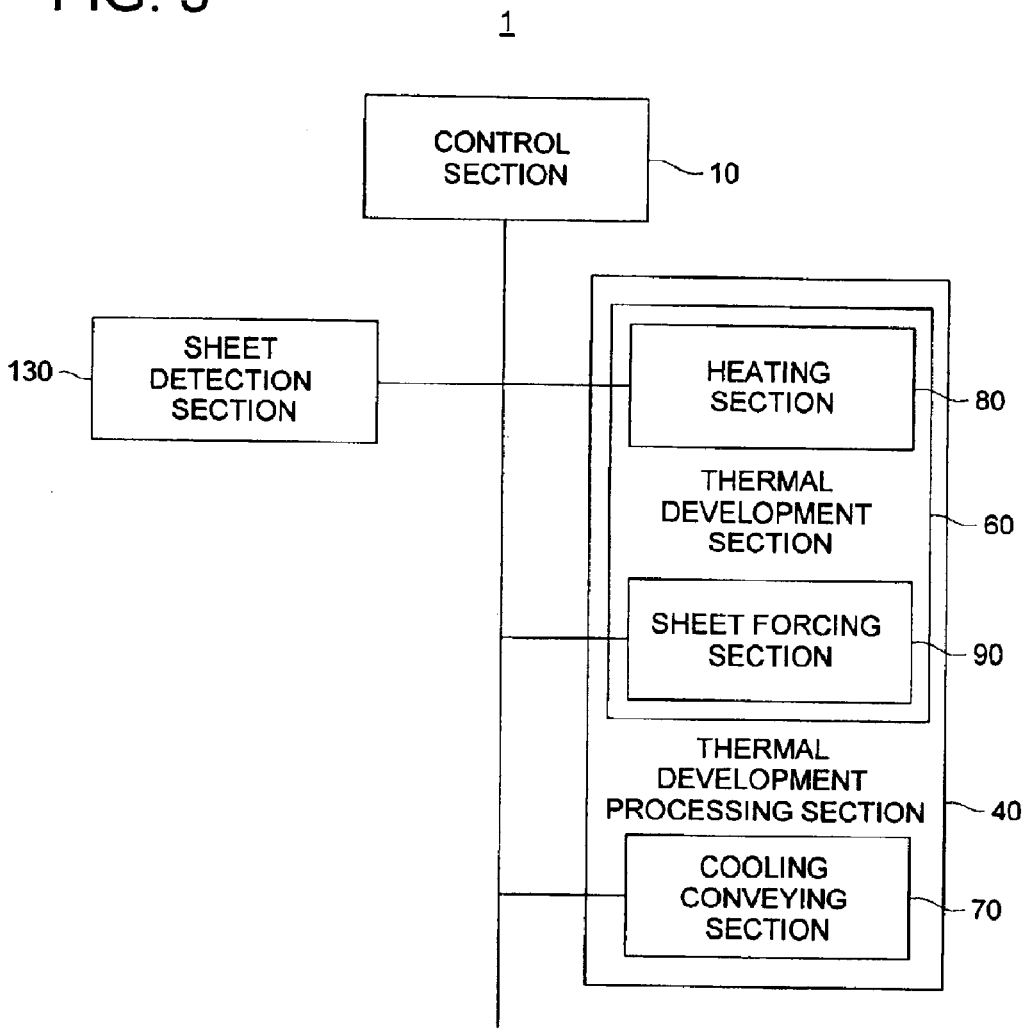
FIG. 3 is a block diagram showing a main portion structure in the first embodiment of the thermal development apparatus according to the present invention.

FIG. 1 is a front sectional view typically showing a thermal development apparatus 1 in the first embodiment of the present invention. FIG. 2 is a front sectional view typically showing a thermal development section in the thermal development apparatus. FIG. 3 is a block diagram showing a main portion structure of the thermal development apparatus.

As shown in FIG. 1, the thermal development apparatus 1 is an apparatus by which the thermal development of a thermal development photosensitive sheet S on which a latent image is formed, is conducted in a thermal development processing section 40. The thermal development processing section 40 is structured by a thermal development section 60 and cooling conveyance section 70. The thermal development section 60 is a section by which the thermal development photosensitive sheet S which is a sheet-like thermal developing photosensitive material is heated and thermally developed, and for example, it is structured by a heating section 80 and sheet forcing section 90. The heating section 80 is, for example, a heating roller, and when the thermal development photosensitive sheet S is forced on the surface of the heating section 80 by the sheet forcing section 90, the thermal development photosensitive sheet S is heated and thermal development processing is conducted.

The cooling conveyance section 70 conveys and delivers the thermally developed thermal development photosensitive sheet S onto a delivery tray HT in the thermal development section 60 while the sheet S is being cooled. The cooling conveyance section 70 is a conveying section to make the temperature changing process of the thermal development photosensitive sheet S constant while the sheet S is conveyed through the cooling conveyance section 70, in the time period in which the thermal development photosensitive sheet S heated in the thermal development section 60 in order to form the desired density image on the thermal development photosensitive sheet S, is delivered onto the delivery tray HT.

In the cooling conveyance section 70, for example, a cooling fan 50 is provided, and the cooling fan 50 conducts the cooling operation to lower the too much risen temperature to the desired temperature in the inside of the cooling conveyance section 70. This is an operation to prevent the temperature changing process for each thermal development photosensitive sheet S in the cooling conveyance section 70 from differing when the temperature in the cooling conveyance section 70 rises by the continuous processing of the thermal development, and the cooling efficiency of the thermal development photosensitive sheet S is lowered. When, by this cooling fan 50, the outside air is taken in, and the lowering of the cooling efficiency of the thermal development photosensitive sheet S is suppressed, the temperature hysteresis of the thermal development photosensitive sheet S can be made constant in the cooling conveyance section 70. For example, the adjustment of the strong and weakness of this cooling operation is conducted by the adjustment of the area of the suction port, the adjustment of the area of the exhaust port, or the adjustment of the air quantity of the cooling fan 50 of the cooling conveyance section 70.

Further, as shown in FIG. 3, the thermal development apparatus 1 is provided with a control section 10 by which the thermal development apparatus 1 is generally controlled, and various kinds of processing and judgment are conducted, and to the control section 10, the thermal development processing section 40, and a sheet detection section 130 are connected through a bus. The control section 10 is, although not shown in the drawing, generally structured by a CPU to conduct various kinds of calculations and processing, ROM in which various kinds of programs for executing various kinds of processing such as the control, judgment, or the data of various kinds of thermal development processing conditions are stored and accommodated, and RAM used as a work memory in each kind of processing.

This control section 10 conducts, in order to conduct the thermal development to visualize the image in a predetermined density range, according to a predetermined processing condition, the control of the processing operation in the thermal development processing section 40, and further, controls each kind of driving section (graphic display is omitted), and controls the conveying operation of the thermal development photosensitive sheet S, thermal development processing operation of the thermal development processing section 40, and cooling operation of the cooling fan 50. Particularly, the control section 10 conducts the control relating to the feed forward control in the present invention.

The control section 10 conducts the control relating to the feed forward control in the present invention according to the processing load (for example, the processing number of sheets per unit time) when the thermal development photosensitive sheet S detected by the sheet detection section 130 is thermal developed. The sheet detection section 130 is a detection section to detect the thermal development photosensitive sheet S which is conveyed to the thermal development processing section 40 and on which the latent image is formed, and is structured by, for example, a photo sensor or contact sensor.

Next, according to the typical drawings of the thermal development apparatus 1 shown in FIG. 1 and FIG. 2, the processing operation of the thermal development apparatus 1 and the processing process of the thermal development photosensitive sheet S will be described.

Initially, the thermal development photosensitive sheet S inputted into the thermal development apparatus 1 is conveyed to a feed roller pair 3 by a sheet taking-out unit 2. The thermal development photosensitive sheet S conveyed to the feed roller pair 3 is sent to a conveying roller pair 4. The conveying roller pair 4 conveys the thermal development photosensitive sheet S along a conveying route R. In this conveying process, the sheet detection section 130 detects the conveying thermal development photosensitive sheet S.

Next, the thermal development photosensitive sheet S is conveyed into the thermal development section 60 by the conveying roller pair 4. The thermal development photosensitive sheet S is urged by the sheet urging section 90 and heated, and conveyed to the heating section 80 which is heated at a predetermined temperature, for example, 125° C., by the rotating movement of the heating section 80 and sheet urging section 90.

Next, the thermal development photosensitive sheet S is conveyed to the cooling conveyance section 70 by the conveying roller pair 4. By activating the cooling fan 50, the temperature excessively increased in the cooling conveyance section 70 can be decreased so as to maintained it at a desired temperature. Further, in the conveying route R in the cooling conveyance section 70, as a guide member 71, for example, a sheet cooling plate is provided, and when the thermal development photosensitive sheet S comes into contact with the sheet cooling plate, by conducting the owned heat of the thermal development photosensitive sheet S to the sheet cooling plate, it is cooled. The cooled thermal development photosensitive sheet S is delivered onto the delivery tray HT by the conveying roller pair 4. In this connection, preferably, in order not to generate the partial temperature change in the thermal development photosensitive sheet S, this cooling fan 50 is made in such a manner that its cooling air does not directly hit the thermal development photosensitive sheet S.

Next, the feed forward controlling operation which is conducted by the control section 10 of the thermal development apparatus 1, embodied in the present invention and conducting the above-described processing, will be detailed in the following. The control according to the thermal development apparatus 1 of the present invention is the control of various factors in each section in the thermal development apparatus 1 which easily influences the density variation of the image so that the density of the visualized image is within a predetermined density range, even also for the thermal development photosensitive sheet S which is thermal development processing is conducted at any timing when the thermal development photosensitive sheet S is thermally developed. Particularly, as the feed forward control, before the thermal development processing by the heat is conducted on the thermal development photosensitive sheet S, it controls various factors in each section in the thermal development apparatus 1 so that the density of the visualized image is within a predetermined density range.

Specifically, as factors in each section of the thermal development apparatus 1 which easily influence the density variation of the image, there are the conveying speed of the thermal development photosensitive sheet S in the thermal development processing section 40 (thermal development section 60, cooling conveyance section 70), or the temperatures in the heating section 80 and cooling conveyance section 70 equipped in the thermal development section 60, or the activating operations of the cooling fan 50 for controlling the abovementioned temperatures. Accordingly, the control section 10 of the thermal development apparatus 1, embodied in the present invention, controls the abovementioned factors.

For example, since the image density tends to increase when the thermal development is conducted under the condition that the temperature of the heating section 80 of the thermal development section 60, sheet forcing section 90, and cooling conveyance section 70 is higher than a predetermined reference temperature, the control section 10 controls them to increase the conveying speed of the thermal development photosensitive sheet S in the thermal development processing section 40 so as to decrease the image density. As a result, the both are cancelled each other (high processing temperature is cancelled by the fast processing speed), so that the image density is adjusted within a predetermined density range.

Similarly, since the image density tends to decrease when the thermal development is conducted under the condition that the temperature of the heating section 80 of the thermal development section 60, sheet forcing section 90, and cooling conveyance section 70 is lower than a predetermined reference temperature, the control section 10 controls them to decrease the conveying speed of the thermal development photosensitive sheet S in the thermal development processing section 40 so as to increase the image density. As a result, the both are cancelled each other (low processing temperature is cancelled by the slow processing speed), so that the image density is adjusted within a predetermined density range.

In order to conduct such a feed forward control, in the first embodiment, the control of each section which is predetermined corresponding to the processing load in the thermal development apparatus 1, is conducted. For example, depending on how much larger or smaller than the reference processing number of sheets the image processing number of sheets which are thermally developed per unit time by the thermal development apparatus 1 are, the control section 10 controls each section so that the visualized image density is within a predetermined density range.

Specifically, for example, the more the image processing number of sheets which are thermally developed per unit time by the thermal development apparatus 1 are, the lower the temperature of the sheet forcing section 90 is, compared to the reference temperature, since the temperature of the sheet forcing section 90 is taken by the thermal development photosensitive sheet S. Further, because, for the temperature of the cooling conveyance section 70, the heat is supplied by the heated thermal development photosensitive sheet S, the temperature of the cooling conveyance section 70 is more increased than the reference temperature. Accordingly, the adjustment of the exposure amount of the exposure section 30, and/or the adjustment of the conveying speed of the thermal development photosensitive sheet S in the thermal development processing section 40, which are determined corresponding to the image processing number of sheets on which the thermal development is conducted per unit time, is conducted by the feed forward control.

In order to conduct the above feed forward control, the temperature change in the thermal development processing section 40 of the thermal development apparatus 1 by the influence of the image processing number of sheets on which the thermal development apparatus 1 conducts the thermal development per unit time is previously confirmed by the simulation. Then, a program by which the adjustment of the conveying speed of the thermal development photosensitive sheet S in the thermal development processing section 40 is conducted by the feed forward control as described above so that the influence of the temperature change is cancelled and the density of the visualized image by the thermal development processing is within a predetermined density range, is previously stored and accommodated in ROM. Then, the control section 10 conducts the control according to the program. As the program to conduct such a feed forward control, there is a program, for example, by which the increase of the density brought by the temperature rise of the cooling conveyance section 70 is cancelled by increasing the conveying speed of the thermal development photosensitive sheet S in the thermal development section 60, or a program by which the lowering of the density brought by the temperature lowering of the sheet forcing section is cancelled by the speed reduction of the conveying speed of the thermal development photosensitive sheet S in the thermal development section 60, or a program in which these programs are combined.

Figure 4:
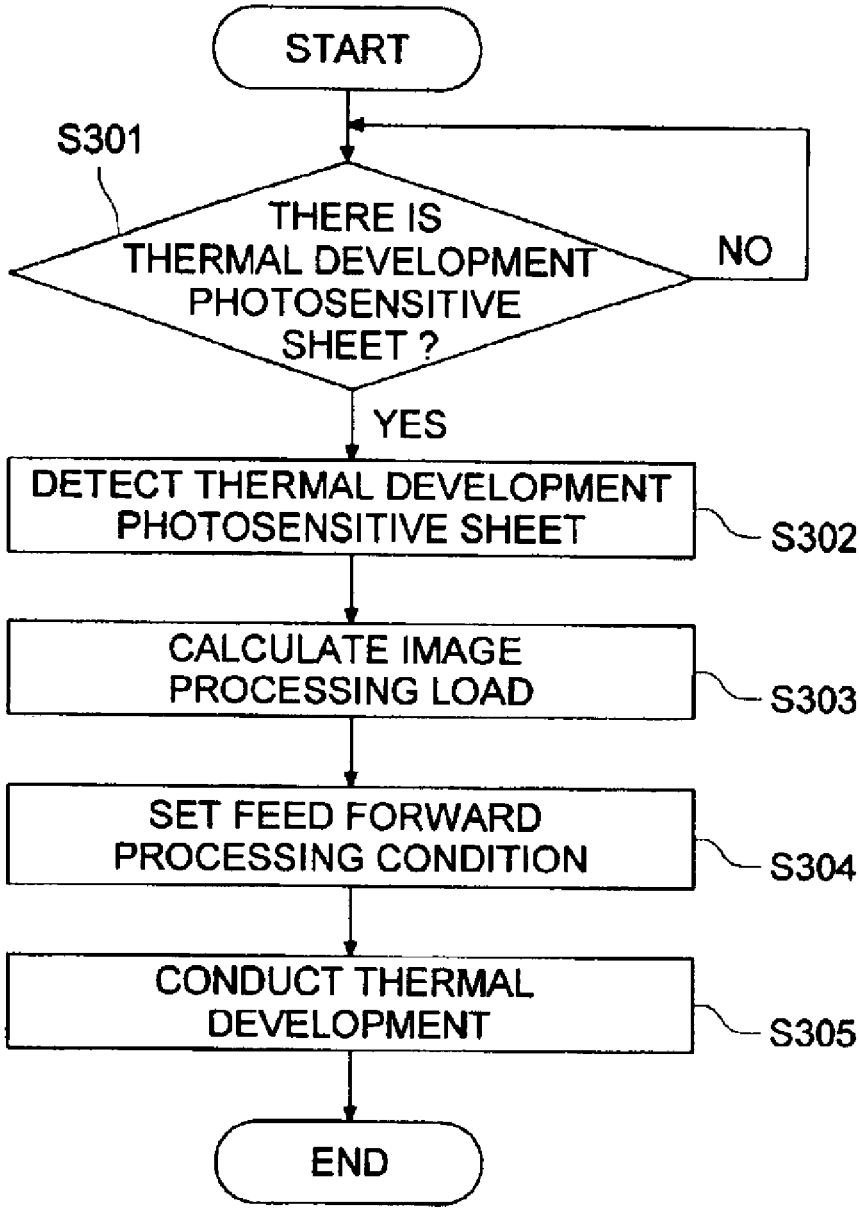
FIG. 4 is a flowchart showing the operation in the first embodiment according to the present invention.

Next, the operation in the thermal development apparatus 1 structured as described above will be described along the flowchart shown in FIG. 4. In FIG. 4, when the power source of the thermal development apparatus 1 is turned ON, and the thermal development processing is started, initially, the control section 10 detects by the sheet taking out unit 2, whether the thermal development photosensitive sheet S on which the thermal development is conducted is put-in, and accommodated, (step S301), and when it is detected that the thermal development photosensitive sheet S is put-in, and accommodated, (step S301; Yes), the sequence advances to step S302. Then, the control section 10 makes the sheet detection section 130 detect the thermal development photosensitive sheet S on which the thermal development is conducted, (step S302), and further, the control section 10 calculates the processing load when the detected thermal development photosensitive sheet S is thermally developed (step S303).

Next, the control section 10 extracts the feed forward control program corresponding to the calculated processing load, and sets the processing condition corresponding to the extracted program (step S304). The set of the processing condition according to the feed forward control program in this step S304 is the adjustment to conduct a predetermined operation so that the thermal development is conducted and the density of the visualized image is within a predetermined density range, for example, the adjustment of the conveying speed of the thermal development photosensitive sheet S in the thermal development processing section 40.

Then, the thermal development is conducted by the set processing condition (step S305), and the thermal development processing is completed. That is, the control section 10 detects the existence of the thermal development photosensitive sheet S which is put-in and accommodated in the thermal development apparatus 1 to conduct the thermal development, and according to the calculation result of the processing load when the thermal development photosensitive sheet S is thermally developed, the thermal development is conducted by the feed forward control as the optimum condition to conduct the thermal development always, by which the density of the visualized image by the thermal development processing is within a predetermined density range.

As described above, in the thermal development apparatus 1, by the feed forward controlling operation for various kinds of processing conditions relating to the thermal development, when the adjustment of the conveying speed of the thermal development photosensitive sheet S is conducted in the thermal development processing section 40, the density of the image visualized by the thermal development processing can be maintained within a predetermined density range. Particularly, the processing lord on which the thermal developing apparatus 1 conducts the thermal development, for example, by the image processing number of sheets on which the thermal development is conducted per unit time, or the kind, size and thermal capacity of the thermal development photosensitive sheet S, the temperature change which influences the density variation in the thermal development processing section 40, is previously confirmed by the simulation, and the operation condition of each section corresponding to such a temperature change is programmed, and when the thermal development corresponding to the program is conducted, the thermal, development within the desired density range can be conducted.

(The Second Embodiment)

Figure 5:
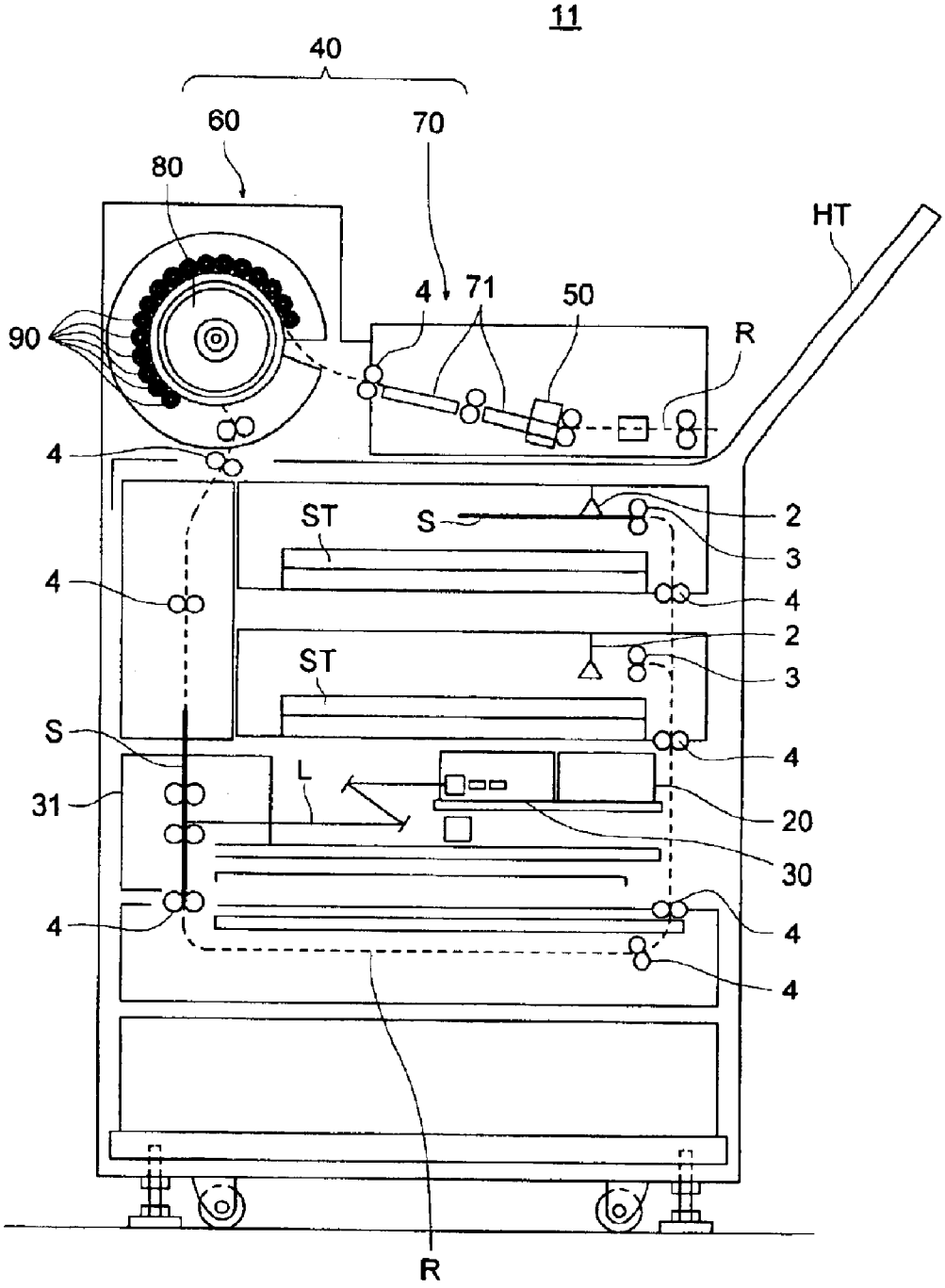
FIG. 5 is a front sectional view typically showing the thermal development apparatus in the second embodiment according to the present invention.
Figure 6:
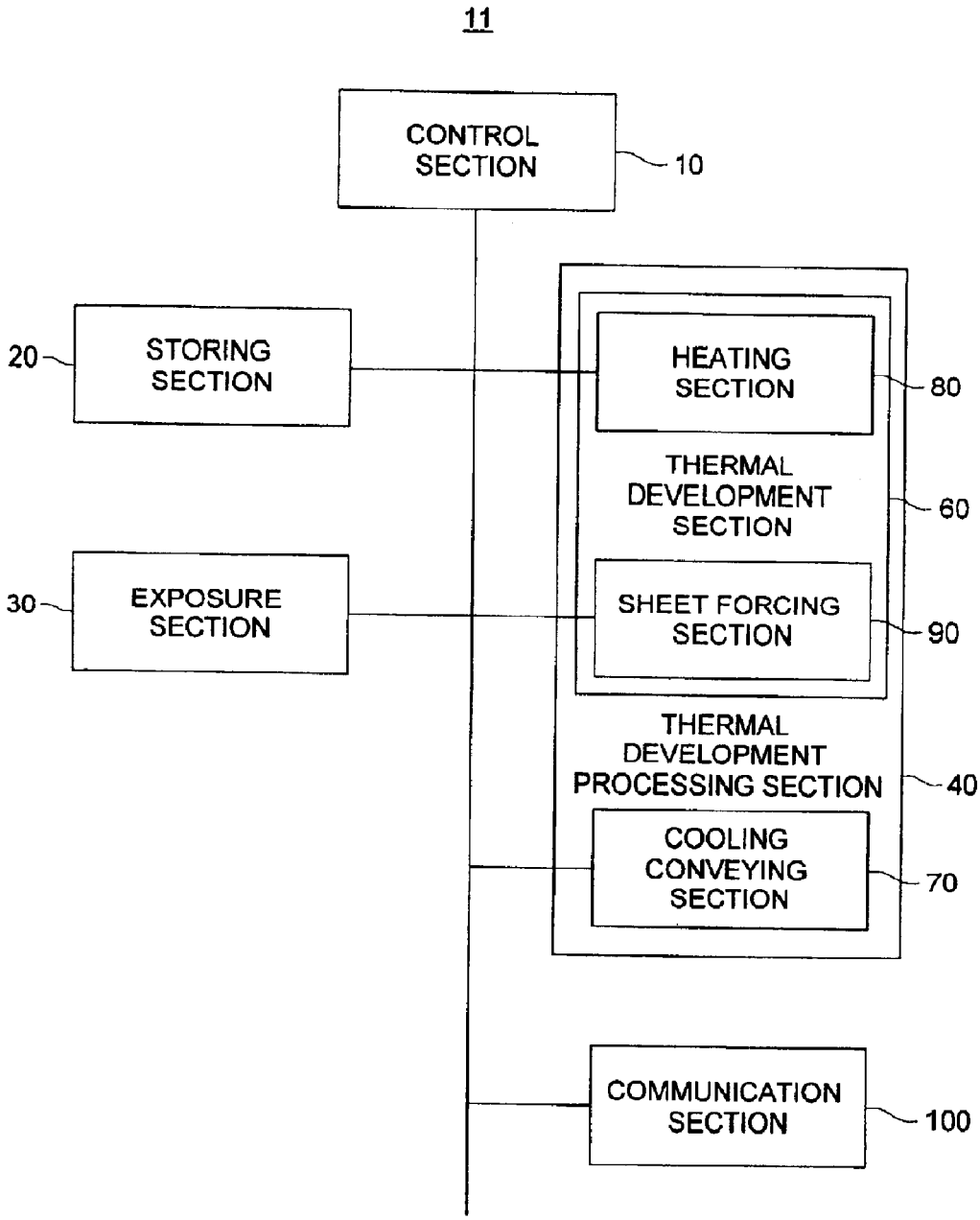
FIG. 6 is a block diagram showing the main portion structure in the second embodiment of the thermal development apparatus according to the present invention.

Next, the thermal development apparatus in the second embodiment of the present invention will be described. FIG. 5 is a front sectional view typically showing the thermal development apparatus 11 in the second embodiment of the present invention. FIG. 6 is a block diagram showing the main portion structure of the thermal development apparatus 11.

In this connection, because the thermal development apparatus 11 includes almost the same structure as the thermal development apparatus 1 in the first embodiment, only the different part will be described. As shown in FIG. 5, the thermal development apparatus 11 is an apparatus by which the thermal development photosensitive sheet S which is the sheet-like thermal developing photosensitive material which is exposure processed in the exposure section 30 as the latent image forming section, is thermally processed in the thermal development processing section 40 and the thermal development is conducted.

The storing section 20 is, for example, a storing medium such as a hard disk, and receives and stores the image data representing the images to be developed by thermal developing operation. The image data are sent from the outside apparatus connected through the communication line. The exposure section 30 exposes the thermal development photosensitive sheet S by irradiating the laser light L whose intensity is modulated according to the digital image signal, onto it, and the latent image is formed on the thermal development photosensitive sheet S.

Further, as shown in FIG. 6, the thermal development apparatus 11 is provided with a control section 10 which generally controls the thermal development apparatus 11 and conducts various kinds of processing and judgments, and to the control section 10, the storing section 20 in which the image data are stored, exposure section 30, thermal development processing section 40, and communication section 100 are connected through the bus.

The control section 10 is generally structured by, although not shown in the drawings, the CPU which conducts various kinds of arithmetic processing, various kinds of programs for the controlling and judgments, or ROM in which the data of various kinds of thermal development processing conditions are stored and accommodated, and RAM used as the work memory in various kind of processing.

This control section 10 conducts the controlling operation for the exposure section 30 and/or thermal development processing section 40 according to a predetermined processing condition in order to conduct the thermal development by which the image is visualized within a predetermined density range, further, controls various kinds of drive sections (not shown in the drawings), and conducts the controlling operation for conveying the thermal development photosensitive sheet S, the controlling operation for the exposure processing in the exposure section 30, the controlling operation for the thermal development processing in the thermal development processing section 40, the controlling operation for cooling the cooling conveyance section 70, and the controlling operation for the communication processing in the communication section 100. Particularly, the controlling operations relating to the feed forward control, embodied in the present invention, are conducted. For example, this control section 10 conducts the control as the calculating means by which the processing number of sheets per unit time is calculated according to the quantity of the image data stored in the storing section 20. Further, the control section 10 conducts the control as the store control means by which the image data received by the communication section 100 is stored in the storing section 20. The communication section 100 communicates with the outside apparatus through the communication line, and for example, the image data transmitted from the outside apparatus is received.

Next, according to the typical view of the thermal development apparatus 11 shown in FIG. 5, the processing movement of the thermal development apparatus 11 and processing process of the thermal development photosensitive sheet S will be described.

Initially, the thermal development photosensitive sheet S accommodated in the accommodation tray ST is taken out by the sheet take-out unit, and conveyed to the feed roller pair 3. The thermal development photosensitive sheet S conveyed to the fed roller pair 3 is sent to the conveying roller pair 4. The conveying roller pair 4 conveys the thermal development photosensitive sheet S along the conveying route R. Then, in the exposure position 31 provided on the conveying route R, the exposure section 30 irradiates the laser light L onto the thermal development photosensitive sheet S and exposes it, and the latent image is formed on the thermal development photosensitive sheet S.

Next, the thermal development photosensitive sheet S is conveyed to the thermal development section 60 by the conveying roller pair 4. The thermal development photosensitive sheet S is forced onto the heating section 80 which is heated to a predetermined temperature, for example, 125° C., by the sheet forcing section 90 and heated, and conveyed by the rotating movement of the heating section 80 or sheet forcing section 90.

Next, the thermal development photosensitive sheet S is conveyed to the cooling conveyance section 70 by the conveying roller pair 4. In the cooling conveyance section 70, by the movement of the cooling fan 50, the too much risen temperature is lowered and the temperature of the sheet S is maintained to the desired temperature. Further, on the conveying route R in the cooling conveyance section 70, as the guide member 71, for example, the sheet cooling plate is provided, and in the case where the thermal development photosensitive sheet S comes into contact with the sheet cooling plate, when the heat stored in the thermal development photosensitive sheet S is conducted to the sheet cooling plate, it is cooled. The cooled thermal development photosensitive sheet S is delivered to the delivery tray HT by the conveying roller 4. In this connection, for the cooling fan 50, it is preferable that the cooling air may be made not to directly hit the thermal development photosensitive sheet S so that the local temperature change is not generated.

Next, the feed forward control which is conducted by the control section 10 of the thermal development apparatus 11 of the present invention and by which the processing movement as described above is conducted, will be described.

The control according to the thermal development apparatus 11 of the present invention controls, when the thermal development photosensitive sheet S is thermally developed, also even the thermal development photosensitive sheet S on which the thermal development processing is conducted at any timing, various factors in each section of the thermal development apparatus 11 which easily influence the density variation of the image, so that the density of the visualized image is within a predetermined density range.

Specifically, precedent to the operation for applying the exposure processing for forming the latent image or the heating processing for thermally developing the latent image, the control section 10 of the thermal development apparatus 11, embodied in the present invention, controls various kinds of factors for each of the sections in the thermal development apparatus 11 as the feed forward controlling operations so as to maintain the density of the visualized image within a predetermined density range.

Concretely speaking, as factors in each section of the thermal development apparatus 11 which easily influences the density variation of the image, there are the exposure amount of the exposure section 30, conveying speed of the thermal development photosensitive sheet S in the thermal development processing section 40 (thermal development section 60, cooling conveyance section 70), or temperature of the heating section 80 of the thermal development section 60 or cooling conveyance section 70, or movement of the cooling fan 50 to control the temperature, and they are controlled. For example, when the thermal development is conducted under the condition that the temperature of the heating section 80 or sheet forcing section 90 of the thermal development section 60 or cooling conveyance section 70 is higher than the predetermined reference temperature, because the image density tends to be thick, the control of the lowering of the exposure amount of the exposure section 30, or the increasing of the conveying speed of the thermal development photosensitive sheet S in the thermal development processing section 40, is conducted so that the image density is thin, and the image density is adjusted so that it is within a predetermined density range.

In the same manner, when the thermal development is conducted under the condition that the temperature of the heating section 80 or sheet forcing section 90 of the thermal development section 60 or cooling conveyance section 70 is lower than the predetermined reference temperature, because the image density tends to be thin, the control of the increasing of the exposure amount of the exposure section 30, or the decreasing of the conveying speed of the thermal development photosensitive sheet S in the thermal development processing section 40, is conducted so that the image density is thick, and the image density is adjusted so that it is within a predetermined density range.

In order to conduct such a feed forward control, in the present second embodiment, according to the quantity of the image data stored in the storing section 20 which is the processing load in the thermal development apparatus 11, the control corresponding to the image processing number of sheets in which the thermal development apparatus 11 conducts the thermal development per unit time, is conducted. That is, depending on how much larger or smaller than the reference processing number of sheets, the image processing number of sheets in which the thermal development apparatus 11 conducts the thermal development per unit time is, the control of each section is conducted so that the density of the visualized image is within a predetermined density range.

Specifically, for example, the larger the image processing number of sheets on which the thermal development apparatus 11 conducts the thermal development per unit time is, the more the temperature of the sheet forcing section 90 is taken by the thermal development photosensitive sheet S, and the temperature of the sheet forcing section 90 decreases lower than the reference temperature. Further, the temperature of the cooling conveyance section 70 increases higher than the reference temperature because the heat is supplied from the heated thermal development photosensitive sheet S. Accordingly, the adjustment of the exposure amount of the exposure section 30 and/or the adjustment of the conveying speed of the thermal development photosensitive sheet S in the thermal development processing section 40, which are determined corresponding to the image processing number of sheets which are thermally developed per unit time, is conducted by the feed forward control.

In order to conduct the above feed forward control, the temperature change in the thermal development processing section 40 of the thermal development apparatus 11 by the influence of the image processing number of sheets on which the thermal development apparatus 1 conducts the thermal development per unit time is previously confirmed by the simulation. Then, a program by which the adjustment of the exposure amount of the exposure section 30, or the adjustment of the conveying speed of the thermal development photosensitive sheet S in the thermal development processing section 40 is conducted by the feed forward control as described above so that the influence of the temperature change is cancelled and the density of the visualized image by the thermal development processing is within a predetermined density range, is previously stored and accommodated in ROM. Then, the control section 10 conducts the control according to the program. As the program to conduct such a feed forward control, there is a program, for example, by which the increase of the density brought by the temperature rise of the cooling conveyance section 70 is cancelled by increasing the conveying speed of the thermal development photosensitive sheet S in the thermal development section 60, or a program by which the lowering of the density brought by the temperature lowering of the sheet forcing section is cancelled by the speed reduction of the conveying speed of the thermal development photosensitive sheet S in the thermal development section 60, a program by which the increasing of the density brought by the temperature rise of the cooling conveyance section 70 or the lowering of the density brought by the temperature lowering of the sheet forcing section is cancelled by the exposure amount, or a program in which these programs are combined.

Figure 7:
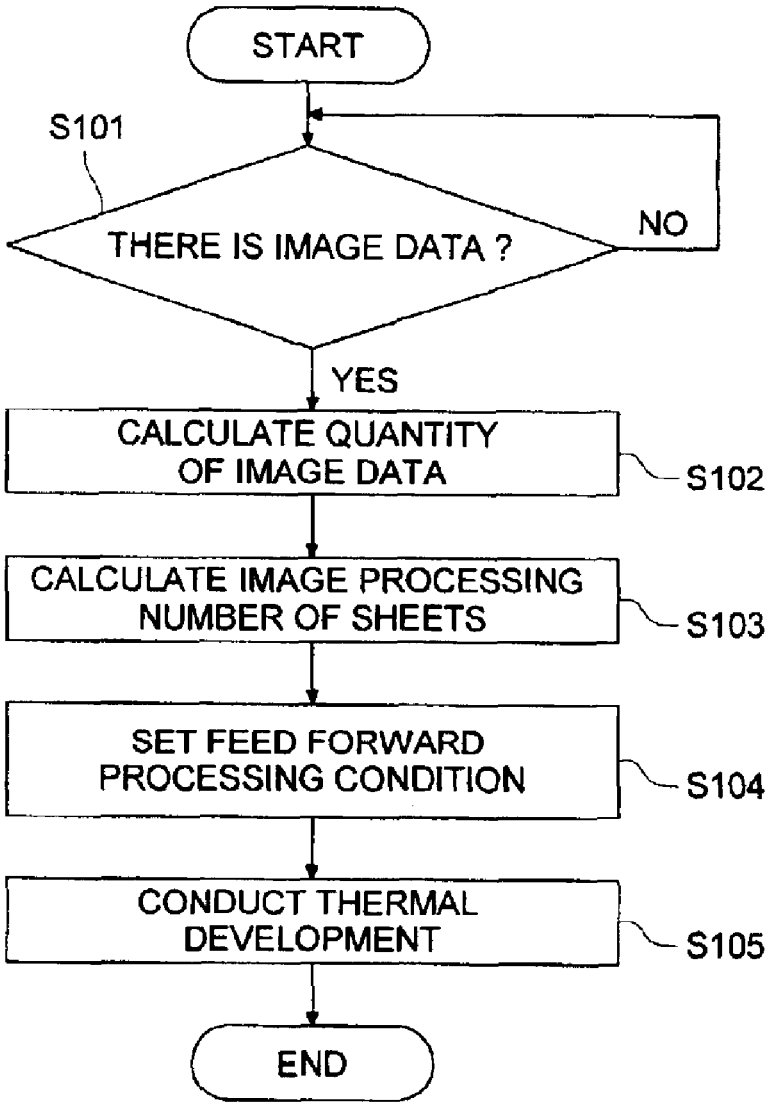
FIG. 7 is a flowchart showing the operation in the second embodiment according to the present invention.

Next, the operation in the thermal development apparatus 11 structured as described above will be described along the flowchart shown in FIG. 7. In FIG. 7, when the power source of the thermal development apparatus 11 is turned ON, and the thermal development processing is started, initially, the control section 10 detects whether the image data stored to conduct the thermal development exists in the storing section 20, (step S101), and when it is detected that the image data exists, (step S101; Yes), the sequence advances to step S102. Then, the control section 10 detects the quantity of the image data stored in the storing section 20 (step S102), and further, the control section 10 calculates the image processing number of sheets on which the thermal development apparatus 11 conducts the thermal development per unit time according to the quantity of the detected image data (step S103).

Next, the control section 10 extracts the feed forward control program corresponding to the calculated image processing number of sheets on which the thermal development is conducted per unit time, and sets the processing condition corresponding to the extracted program (step S104). The set of the processing condition according to the feed forward control program in this step S104 is the adjustment to conduct a predetermined operation so that the thermal development is conducted and the density of the visualized image is within a predetermined density range, for example, the adjustment of the exposure amount of the exposure section 30, or the adjustment of the conveying speed of the thermal development photosensitive sheet S in the thermal development processing section 40.

Then, the thermal development is conducted by the set processing condition (step 1305), and the present thermal development processing is completed. That is, the control section 10 conducts, according to the result of the detection of the existence of the image data stored in the storing section 20 to conduct the thermal development, the detection of quantity of the image data, and the calculation of the image processing number of sheets on which the thermal development is conducted per unit time, the thermal development by the feed forward control as the optimum condition to conduct the thermal development always, by which the density of the visualized image by the thermal development processing is within a predetermined density range.

As described above, in the thermal development apparatus 11, by the feed forward control of each kind of processing condition relating to the thermal development, when the adjustment of the exposure amount of the exposure section 30, or adjustment of the conveying speed of the thermal development photosensitive sheet S is conducted in the thermal development processing section 40, the density of the image visualized by the thermal development processing can be within a predetermined density range. Particularly, depending on the image processing number of sheets on which the thermal developing apparatus 11 conducts the thermal development per unit time, the temperature change which influences the density variation in the thermal development processing section 40, is previously confirmed by the simulation, and the operation condition of each section corresponding to such a temperature change is programmed, and when the thermal development corresponding to the program is conducted, the thermal development within the desired density range can be conducted.

(The Third Embodiment)

Figure 8:
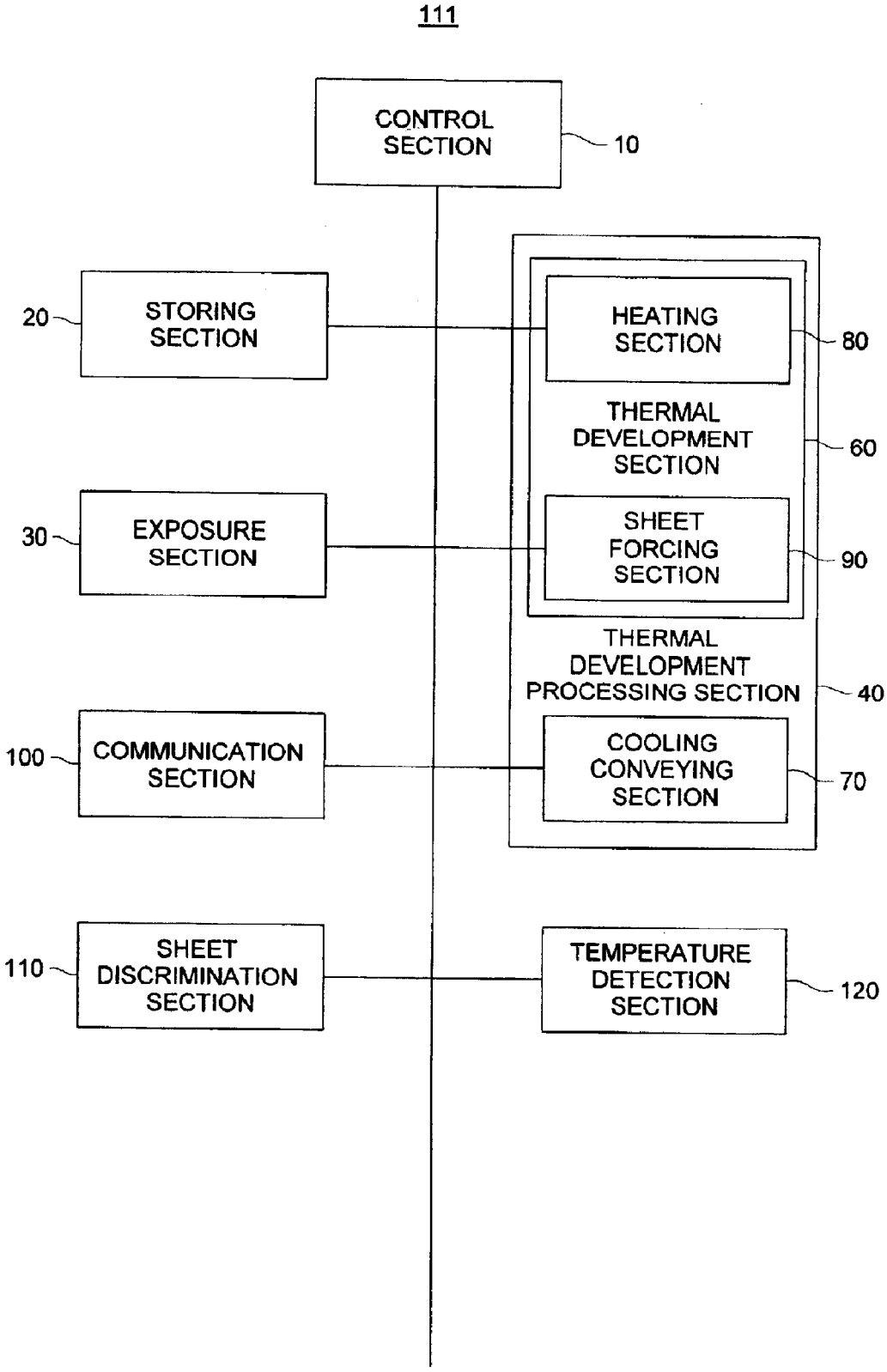
FIG. 8 is a block diagram showing the main portion structure in the third embodiment of the thermal development apparatus according to the present invention.

Next, the thermal development apparatus in the third embodiment of the present invention will be described. FIG. 8 is a block diagram showing a main portion structure of the thermal development apparatus 111 in the third embodiment of the present invention. In this connection, because the thermal development apparatus 111 is almost the same structure as the thermal development apparatus 1 in the first embodiment or the thermal development apparatus 11 in the second embodiment, only the different part will be described.

The sheet discrimination section 110 is a detection section as a discriminating means by which the kind of thermal development photosensitive sheet S is detected, and for example, it is provided in the accommodation tray ST, it reads the bar code provided on a display plate showing the kind of the thermal development photosensitive sheet S accommodated in the accommodation tray ST, and detects the kind of the thermal development photosensitive sheet S.

The temperature detection section 120 is a temperature sensor as the ambient temperature detection means for detecting the ambient temperature of the space (room) in which the thermal development apparatus 111 is installed, and although the graphic display is not shown, for example, the cooling fan 50 is provided near the outside air suction port for cooling the inside of the thermal development apparatus 111.

As described above, the thermal development apparatus 111 is an apparatus in which the sheet discrimination section 110, and temperature detection section 120 are further provided in the thermal development apparatus 11, and in addition to the feed forward control in the second embodiment, further conducts the control relating to the processing condition corresponding to the kind of the thermal development photosensitive sheet S or the processing condition corresponding to the ambient temperature of the space (room) in which the thermal development apparatus 111 is installed.

That is, depending on the kind of the thermal development photosensitive sheet S, when the exposure amount necessary for visualizing the image data into the same density, or the heat amount at the thermal development is different, it is necessary that the adjustment of the exposure amount corresponding to the kind of the thermal development photosensitive sheet S or the adjustment of the heating amount is conducted. Further, because the thermal conductivity (thermal capacity) is different depending on the size, thickness, or material of the sheet, the quantity of heat taken from the sheet forcing section 90 by the thermal development photosensitive sheet S at the time of thermal development,(the temperature amount in which the temperature of the sheet forcing section 90 is lowered) or the quantity of heat which is transmitted to the cooling conveyance section 70 by the thermal development photosensitive sheet S, is different, thereby there is a case where the temperature change of the thermal development processing section 40 is influenced.

Further, also by the ambient temperature of the space (room) in which the thermal development apparatus 111 is installed, the temperature change of the thermal development processing section 40 is influenced. For example, when the ambient temperature of the space (room) in which the apparatus is installed, is low, because the heat of the thermal development processing section 40 is easily transmitted to the outside of the thermal development processing section 40 (the thermal development apparatus 111), it can be said that the inside temperature of the thermal development processing section 40 comparatively hardly rises, or is easily cooled. Particularly, when the outside air is introduced by the cooling fan 50 and the inside of the thermal development processing section 40 is cooled, the heat is maintained in the thermal development processing section 40. Further, in such a case, it can be said that, even when the outside air is introduced by the cooling fan 50, the cooling efficiency is no good.

Accordingly, also the processing condition corresponding to the kind of the thermal development photosensitive sheet S, or the ambient temperature of the space (room) in which the thermal development apparatus 111 is installed, by adding to the feed forward control, the more stable thermal development can be conducted. In order to conduct the above-described feed forward control, the influence of the image processing number of sheets on which the thermal development apparatus 111 conducts the thermal development per unit time, the kind of the thermal development photosensitive sheet S, or the temperature change in the thermal development processing section 40 of the thermal development apparatus 111 by the ambient temperature of the space (room) in which the thermal development apparatus 111 is installed, is previously confirmed by the simulation. Then, a program by which the influence of the temperature change is cancelled, and the adjustment of the exposure amount of the exposure section 30, or the adjustment of the conveying speed of the thermal development photosensitive sheet S in the thermal development processing section 40, so that the density of the visualized image by the thermal development processing is within a predetermined density range, is conducted by the feed forward control as described above, is previously stored and accommodated in the ROM. Then, the control section 10 conducts the control according to the program. As such a program, there is a program corresponding to the kind of the thermal development photosensitive sheet S, or a program in which the ambient temperature of the space (room) in which the thermal development apparatus 111 is installed, is divided into the temperature zones of, for example, 10, 20 and 30° C., and a temperature zone type program corresponding to each zone is combined with the program in the first embodiment.

Figure 9:
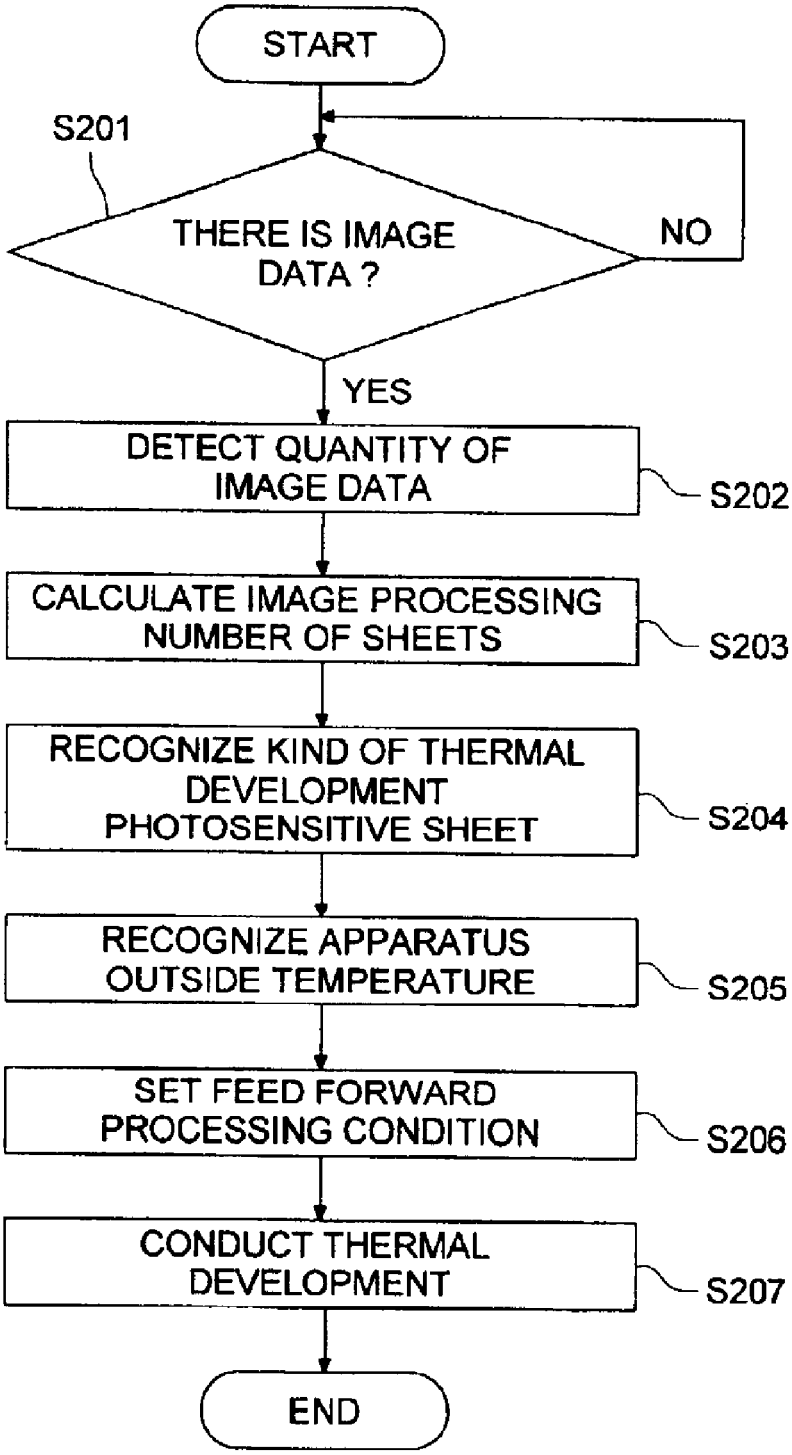
FIG. 9 is a flowchart showing the operation in the third embodiment according to the present invention.

Next, the operation in the third embodiment of the preset invention will be described along the flowchart shown in FIG. 9. In FIG. 9, when the power source of the thermal development apparatus 111 is turned ON, and the thermal development processing is started, initially, the control section 10 detects whether the image data stored to conduct the thermal development exists in the storing section 20 (step S201), and when it is detected that the image data exists (step S101; Yes), the sequence advances to step S202. Then, the control section 10 detects the quantity of the image data stored in the storing section 20 (step S202), and further, the control section 10 calculates the image processing number of sheets on which the thermal development apparatus 111 conducts the thermal development per unit time according to the quantity of the detected image data (step S203).

Then, the control section 10 recognizes the kind of the thermal development photosensitive sheet S according to the signal showing the kind of the thermal development photosensitive sheet S detected by the sheet detection section 110 (step S204). Further, the control section 10 recognizes the temperature according to the signal showing the ambient temperature (the outside temperature of the thermal development apparatus 111) of the space (room) in which the thermal development apparatus 111 is installed, detected by the temperature detection section 120 (step S205).

Next, the control section 10 extracts the feed forward control program corresponding to the calculated image processing number of sheets on which the thermal development is conducted per unit time, the recognized kind of the thermal development photosensitive sheet S or the outside temperature of the thermal development apparatus 111, and sets the processing condition corresponding to the extracted program (step S206).

Then, the thermal development is conducted at the set processing condition (step S207), and the present thermal development processing is completed. That is, the control section 10 conducts the feed forward control so that the density of the visualized image by the thermal development processing as the optimum condition to conduct the thermal development always, is within a predetermined density range, according to the result of the detection of the existence of the image data stored in the storing section 20 in order to conduct the thermal development, detection of the quantity of the image data, and calculation of the image processing number of sheets on which the thermal development is conducted per unit time, and conducts the thermal development.

As described above, in the thermal development apparatus 111, by the feed forward control of each kind of processing condition relating to the thermal development, when the adjustment of the exposure amount of the exposure section 30, or the adjustment of the conveying speed of the thermal development photosensitive sheet S in the thermal development processing section 40, is conducted, the density of the image visualized by the thermal development processing can be within a predetermined density range. Particularly, in addition to the image processing number of sheets on which the thermal development apparatus 111 conducts the thermal development per unit time, the temperature change in the thermal development processing section 40 in which the kind of the thermal development photosensitive sheet S or the temperature change in the thermal development processing section 40 in which the temperature of the periphery of the thermal development apparatus 111 is considered, is previously confirmed by the simulation, and the operation condition of each section corresponding to such a temperature change is programmed, and by conducting the thermal development corresponding to the program, the thermal development within a desired density range can be conducted.

Further, it may also be structured in such a manner that, in the thermal development apparatus 111, the temperature detection section 120 as the temperature sensor to detect the temperature of the periphery of the exposure section 30 of the thermal development apparatus 111 as the latent image forming section temperature detection means is further provided, and the temperature of the periphery of the exposure section 30 is detected, and the feed forward control to conduct the thermal development corresponding to the change of the processing condition brought by the wavelength change of the exposure light emitted from the exposure section 30 at the temperature, is conducted. Because the wavelength of the emitted light emitted by the exposure section 30 varies depending on the temperature of the atmosphere of the periphery of the exposure section 30, such a control is effective.

Further, it may also be structured in such a manner that the detection section to detect the deterioration situation of the thermal development section 60, for example, the situation of the surface of the heating section 80 is detected by a color detection section to detect the color of the surface of the heating section 80, reflection factor detection section to detect the reflection factor of the surface of the heating section 80, undulation detection section to detect the coarseness (concave and convex) of the surface of the heating section 80, and the thickness detection section to detect the thickness of the surface layer of the heating section 80, and the feed forward control to conduct the thermal development corresponding to the change of the processing condition brought by the change of the thermal conductivity of the heating section 80 according to the situation of the deterioration and soil of the heating section 80, is conducted. Further, it may also be structured in such a manner that the deterioration situation of the thermal development section 60 or heating section 80 is recognized and judged also by the quantitative numeral value detected by the using period detection section to detect the using period of the thermal development apparatus 111, and accumulation processing number detection section to detect the accumulation processing number of the thermal development photosensitive sheet S which is thermally developed, and the feed forward control to conduct the thermal development corresponding to the change of the processing condition brought by the change of the thermal conductivity of the heating section 80, is conducted.

In this connection, in the above embodiments, although the heating section 80 is shown and described as a heating drum, and sheet forcing section 90 is shown and described as a sheet forcing roller, the present invention is not limited to this, but the structure of the heating section 80 and sheet forcing section 90 is optional. Further, the quantity of the image data means the number of sheets of the image, film size of the image, and image data capacity, and it is the reference of the processing number of sheets of the image which is thermally developed. Further, the structure of the exposure section 30 of the thermal development apparatus 11 is also optional, and in addition to that, it is of course that specific fine structure may also be appropriately modified.

According to the present invention, the following effects can be attained.

(1) When the thermal developing photosensitive material is thermal developed, because the feed forward control according to the processing condition which is previously set corresponding to the processing load (for example, the processing number of sheets per unit time) of the thermal developing photosensitive material is conducted in the thermal development processing section, the desired thermal development can be conducted without confirming the situation at the thermal development or the result after the thermal development. Therefore, because the various detection sensors to confirm the situation at the thermal development or the result after the thermal development like in the case of the feedback control, become unnecessary and the apparatus component members can be decreased, the simplification of the apparatus and the reduction of the cost can be attained.

(2) Since, when at least any one processing condition of the thermal development temperature in the heating section, the thermal development time in the heating section, and the cooling temperature in the cooling conveyance section, is set, the feed forward control can be conducted, the adequate feed forward control can be conducted.

(3) Since the feed forward control according to the previously set processing condition corresponding to the processing load relating to the image data is conducted in at least any one of the latent image forming section, heating section and cooling conveyance section, the desired thermal development can be conducted without confirming the situation at the thermal development or the result after the thermal development. Further, according to the image data stored in the storing means, the time difference until the image data is thermally developed or printed for each thermal developing photosensitive material (for example, the time difference until the image data is the latent-image formed on the thermal developing photosensitive material or exposed in the latent image forming section) is calculated, and by controlling the time difference until the image data is thermally developed and printed, (for example, controlling at the timing at which the thermal developing photosensitive material is conveyed), the simulation of the temperature variation by the continuous processing in which the processing number of sheets per unit time at the continuous processing which is the processing load at the time of the thermal development is made uniform, can be conducted easily, and the program to conduct the feed forward control can be comparatively easily set. Accordingly, because the various detection sensors to confirm the situation at the thermal development or the result after the thermal development become unnecessary, and the apparatus component members can be decreased, the simplification of the apparatus and the reduction of the cost can be attained.

(4) According to the amount of the image data stored in the storing means, the calculation means calculates the processing number of sheets per unit time, and the feed forward control, according to the processing condition corresponding to the calculated processing number of sheets per unit time, can be conducted. Accordingly, the desired thermal development can be conducted corresponding to the image data, which is to be thermal developed without confirming the situation at the thermal development or the result after the thermal development.

(5) Since the image data sent from the outside apparatus connected through the communication line can be stored by the storing control means, the image data received from the outside apparatus through the communication line can be collectively thermal development processed, and the thermal development can be conducted by the processing condition corresponding to the load when the collected image data is thermal development processed.

(6) Since the feed forward control can be conducted by setting at least one processing condition of the exposure amount for forming the latent image in the latent image formation processing means, the thermal development temperature of the heating section in the thermal development processing means, the thermal development time of the heating section in the thermal development processing means, and the cooling temperature of the cooling conveyance section in the cooling processing means, the adequate feed forward control can be conducted.

(7) Since, according to the processing condition corresponding to the temperature in the latent image forming section detected by the latent image forming section temperature detection means, the feed forward control can be conducted, even when the wavelength variation of the exposure light emitted by the latent image forming section is caused being brought by the temperature change, or the optical axis is dislocated by the thermal expansion change of each optical part of the latent image forming section, and the light amount variation is caused as a result, according to the processing condition corresponding to the light amount variation, the thermal development can be conducted.

(8) Since, according to the ambient temperature detected by the ambient temperature detection means, and according to the processing condition corresponding to the ambient temperature of the periphery of the thermal development apparatus, the feed forward control can be conducted, the thermal development whose thermal development density difference is further small, in which the environmental temperature in which the thermal development apparatus is installed is included, can be conducted.

(9) Since the feed forward control can be conducted according to the kind of the thermal developing photosensitive material discriminated by the discriminating means, and according to the processing condition corresponding to the kind of the thermal developing photosensitive material, the thermal development whose thermal development density difference is further small, corresponding to the kind of the thermal developing photosensitive material, can be conducted.

(10) Since the feed forward control can be conducted corresponding to the deterioration situation of the heating section in the thermal development apparatus, the thermal development can be conducted corresponding to the change of the thermal conductivity of the heating section brought by the deterioration.

Disclosed embodiment can be varied by a skilled person without departing from the spirit and scope of the invention.

What is claimed is:

1. An apparatus for thermally developing a thermal developing photosensitive material, comprising:

a thermal developing processor to apply a thermal development processing to said thermal developing photosensitive material;

a detector to detect said thermal developing photosensitive material to be conveyed into said thermal developing processor; and a controller to control said thermal developing processor in a feed forward controlling mode based on a processing condition of said thermal developing processor;

wherein said processing condition is established in advance, corresponding to a load of processing said thermal developing photosensitive material detected in advance by said detector.

2. The apparatus of claim 1, wherein said thermal developing processor includes:

a heating section to heat said thermal developing photosensitive material so as to maintain a temperature of said thermal developing photosensitive material at a thermal developing temperature; and a cooling conveyance section to cool said thermal developing photosensitive material from said thermal developing temperature to a predetermined temperature while conveying it.

3. The apparatus of claim 2, wherein said processing condition is at least one of a first processing condition in regard to said thermal developing temperature of said heating section included in said thermal developing processor, a second processing condition in regard to a thermal developing time of said heating section included in said thermal developing processor and a third processing condition in regard to a cooling temperature of said cooling conveyance section included in said thermal developing processor.

4. An apparatus for forming an image on a thermal developing photosensitive material, comprising:

a data storage to store image data in it;

a latent image forming section to form a latent image based on said image data, stored in said data storage, onto said thermal developing photosensitive material;

a thermal developing processor to apply a thermal development processing to said thermal developing photosensitive material so as to convert said latent image to said image, serving as a visible image on it; and a controller to control said latent image forming section and/or said thermal developing processor in a feed forward controlling mode based on a processing condition for forming said image.

5. The apparatus of claim 4, wherein said thermal developing processor includes:

a heating section to heat said thermal developing photosensitive material so as to maintain a temperature of said thermal developing photosensitive material at a thermal developing temperature; and a cooling conveyance section to cool said thermal developing photosensitive material from said thermal developing temperature to a predetermined temperature while conveying it.

6. The apparatus of claim 5, wherein said processing condition includes at least one of a first operating condition for said latent image forming section, a second operating condition for said heating section and a third operating condition for said cooling conveyance section, which are established in advance corresponding to a load of forming said image based on said image data stored in said data storage.

7. The apparatus of claim 6, further comprising:

a calculating section to calculate a number of sheets to be processed per unit time, based on an amount of image data stored in said data storage;

wherein said load is defined as said number of sheets to be processed per unit time; and wherein said controller controls said latent image forming section and/or said thermal developing processor in said feed forward controlling mode based on said processing condition corresponding to said number of sheets to be processed per unit time, calculated by said calculating section.

8. The apparatus of claim 6, further comprising:

a storage controlling section to receive said image data from an external apparatus coupled through a communication network, and to control said data storage so as to store said image data received in it.

9. The apparatus of claim 6, wherein said processing condition is at least one of a first processing condition in regard to said thermal developing temperature of said heating section included in said thermal developing processor, a second processing condition in regard to a thermal developing time of said heating section included in said thermal developing processor, a third processing condition in regard to a cooling temperature of said cooling conveyance section included in said thermal developing processor and a fourth processing condition in regard to an exposing amount for forming said latent image in said latent image forming section.

10. The apparatus of claim 6, further comprising:

a temperature detector to detect a temperature at said latent image forming section;

wherein said controller controls said latent image forming section and/or said thermal developing processor in said feed forward controlling mode based on said processing condition corresponding to said temperature detected by said temperature detector.

11. The apparatus of claim 6, further comprising:

an ambient temperature detector to detect an ambient temperature around said apparatus;

wherein said controller controls said latent image forming section and/or said thermal developing processor in said feed forward controlling mode based on said processing condition corresponding to said ambient temperature detected by said ambient temperature detector.

12. The apparatus of claim 6, further comprising:

a judging section to judge a kind of said thermal developing photosensitive material currently employed for forming said image;

wherein said controller controls said latent image forming section and said thermal developing processor in said feed forward controlling mode based on said processing condition corresponding to said kind of said thermal developing photosensitive material determined by said judging section.

13. The apparatus of claim 6, wherein said controller controls said latent image forming section and/or said thermal developing processor in said feed forward controlling mode based on said processing condition corresponding to a current state of deterioration in respect to said heating section.

14. A method for thermally developing a thermal developing photosensitive material, comprising the steps of:

detecting said thermal developing photosensitive material to be conveyed into a thermal developing processor, which applies a thermal development processing to said thermal developing photosensitive material; and controlling said thermal developing processor in a feed forward controlling mode based on a processing condition for said thermal developing processor;

wherein said processing condition is established in advance, corresponding to a load of processing said thermal developing photosensitive material detected in advance in said detecting step.

15. The method of claim 14, wherein said thermal developing processor includes:

a heating section to heat said thermal developing photosensitive material so as to maintain a temperature of said thermal developing photosensitive material at a thermal developing temperature; and a cooling conveyance section to cool said thermal developing photosensitive material from said thermal developing temperature to a predetermined temperature while conveying it.

16. The method of claim 15, wherein said processing condition is at least one of a first processing condition in regard to said thermal developing temperature of said heating section included in said thermal developing processor, a second processing condition in regard to a thermal developing time of said heating section included in said thermal developing processor and a third processing condition in regard to a cooling temperature of said cooling conveyance section included in said thermal developing processor.

17. A method for forming an image on a thermal developing photosensitive material, comprising the steps of:

storing image data in a data storage;

forming a latent image based on said image data, stored in said data storage, onto said thermal developing photosensitive material;

applying a thermal development processing to said thermal developing photosensitive material so as to convert said latent image to said image, serving as a visible image on it; and controlling a forming operation of said latent image and said thermal development processing in a feed forward controlling mode based on a processing condition for forming said image.

18. The method of claim 17, wherein said thermal development processing includes the steps of:

heating said thermal developing photosensitive material so as to maintain a temperature of said thermal developing photosensitive material at a thermal developing temperature; and cooling said thermal developing photosensitive material from said thermal developing temperature to a predetermined temperature.

19. The method of claim 18, wherein said processing condition includes at least one of a first operating condition for said forming operation of said latent image, a second operating condition for said heating step and a third operating condition for said cooling step, which are established in advance corresponding to a load of forming said image based on said image data stored in said data storage.

20. The method of claim 19, further comprising the steps of:

calculating a number of sheets to be processed per unit time, based on an amount of image data stored in said data storage, each of said sheets corresponding to said thermal developing photosensitive material;

wherein said load is defined as said number of sheets to be processed per unit time; and wherein said controller controls said forming operation of said latent image and said thermal development in said feed forward controlling mode based on said processing condition corresponding to said number of sheets to be processed per unit time, calculated in said calculating step.

* * * * *